US005096198A

United States Patent [19]

Cook

[11] Patent Number: 5,096,198

[45] Date of Patent: Mar. 17, 1992

[54] MECHANICAL GAME DEVICE

[76] Inventor: Gregory A. Cook, 3068 Euclid Heights Blvd., Cleveland Heights, Ohio 44118

[21] Appl. No.: 587,239

[22] Filed: Sep. 24, 1990

[51] Int. Cl.[5] ..... A63F 7/04

[52] U.S. Cl. ..... 273/153 R; 273/118 R

[58] Field of Search ..... 273/108, 109, 113, 115, 273/118 R, 123 R, 124 R, 153 R; 272/19

[56] References Cited

U.S. PATENT DOCUMENTS

| | | | |
|---|---|---|---|
| 3,075,770 | 1/1963 | Young | 273/109 |
| 3,406,971 | 10/1968 | Koff | 273/109 |
| 3,540,731 | 11/1970 | Muncey | 273/109 |
| 4,494,753 | 1/1985 | Wampler | 273/113 |
| 4,545,577 | 10/1985 | Randleman | 273/113 |
| 4,743,023 | 5/1988 | Collier | 273/113 |
| 4,759,547 | 7/1988 | Shin-Tao | 273/113 |
| 4,861,036 | 8/1989 | Watanabe | 273/109 |
| 4,953,863 | 9/1990 | Zeidler et al. | 273/113 |

*Primary Examiner*—Edward M. Coven
*Assistant Examiner*—William M. Pierce
*Attorney, Agent, or Firm*—Pearne, Gordon, McCoy & Granger

[57] ABSTRACT

A mechanical game device for use with rolling balls. The device includes a base block with a plurality of ball receiver pockets that are visible to the player. Located in the base block are a plurality of code blocks adapted for selective insertion in the base block in interchangeable side-by-side relation. Each block has a column of vertical holes that align with the vertical holes of adjacent code blocks to form rows of holes, one hole of each row being a code hole. The base block and code blocks define a number of concealed passages or race means adapted to guide balls through the device to one of a plurality of receiver pockets.

5 Claims, 4 Drawing Sheets

MECHANICAL GAME DEVICE

BACKGROUND OF THE INVENTION

This invention relates to a game device that may be mechanically programmed to respond to a concealed code whereby a player may deduce the code from certain responses of the device to sequential selections from a pattern of selections in which the code is concealed. More particularly, the device relates to the use of gravity movement of rolling balls, such as metal spheres or marbles, through an internal hidden array of ball races to provide information to a player from which the code may be deduced after a series of plays.

The device includes means by which a single player may mechanically establish and change a concealed code without knowing the code selected and then manipulate the device sequentially to deduce the code. The object of the game is generally to deduce the code in a minimum number of sequential selections.

Games of the type generally referred to as "parlor games" are becoming increasingly popular in modern society, and especially games which challenge the intellect of the player or players. In particular, games that call upon deductive reasoning in order to meet certain challenges set by the game rules have achieved considerable interest.

A typical example is a game presently manufactured and sold under the trademark "MASTER MIND." In that game, two or more players attempt to deduce, by a sequence of selections, a numerical code that is concealed in a pattern or matrix of parallel columns and rows. Each play by one of the players results in information that could include the tally of selections in either the correct or incorrect positions of the code. On the other hand, the particular selection might provide no information other than that both the individual selection and the particular row are incorrect. Utilizing the results of a series of selections, a player may deduce the code. The challenge to the player is to deduce the code in a minimum number of plays.

One of the limitations of the type of game described is that at least two players are required, one being a passive player who must provide information to the active player. The device of the present invention, however, enables one or more players, by means of certain manipulations, to establish a code that is unknown to him and then undertake a series of plays from which the code he established may be deduced.

SUMMARY OF THE INVENTION

It is among the objects of the present invention to provide a game device that enables a single player to program an unknown code by mechanical manipulation, and thereafter, through a series of plays, deduce the code through information provided to the player as a result of sequential selection of choices from a geometrical array comprising a pattern of columns and rows in which the code is concealed.

In accordance with the invention, a mechanical game device is provided wherein the gravitational movement of rolling game balls from selectable holes, through a changeable passage means to exit pockets in accordance with a concealed code, provides facts to the player from which to deduce the concealed code. The device includes a base block having first, second, and third ball receiver pockets that are visible to the player. Located in the base block are a plurality of code blocks adapted for selective insertion in the base block in interchangeable side-by-side assembled relation. Each block has a column of vertical holes that align with the vertical holes of adjacent code blocks to form rows of holes, one hole of each row being a code hole. The base block has a plurality of holes in its top face arranged in columns and rows that align with the vertical holes of the columns and rows of the assembly of code blocks within the base block.

The device further includes a first race means defined by the code blocks and the base block for conveying a ball inserted in the code hole of one of the code blocks to the first ball receiver pocket. A second race means is defined by the code blocks and the base block for conveying a ball inserted in any other hole in the same row as one of the code holes of one of the code blocks from its hole in that row to the second ball receiver pocket. A third race means is defined by the code blocks and the base block for conveying a ball inserted in any one of the other holes in a row having none of the code holes from that hole to the third ball receiver pocket.

In accordance with the preferred form of the invention, a release gate means is provided that may be manipulated from a position inserted in the base block wherein a group of balls have been placed in selected base block holes, and a second position wherein holes in the release gate align with the holes in the top face of the base block and in the code blocks to permit the game balls to pass and be received by the first, second, and third race means.

The game is generally played by an individual player who places one ball in each column and then observes the result when the balls are released for passage to the receiver pockets. This play is then repeated and the player utilizes the information obtained from the location of the balls in the respective receiver pockets to ultimately deduce the predetermined hidden code.

DESCRIPTION OF THE PREFERRED EMBODIMENT

Figure 1:
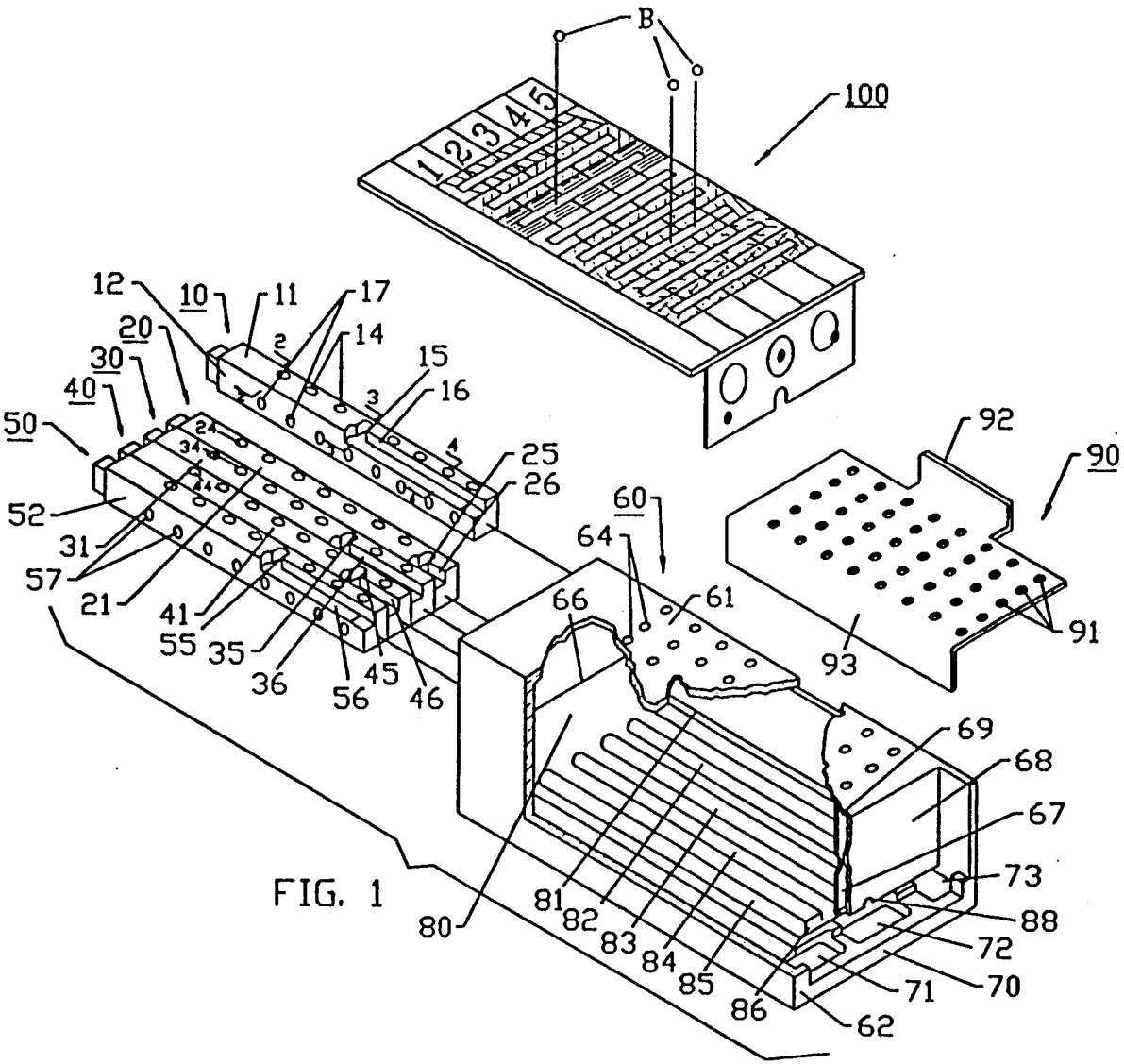
FIG. 1 is an exploded perspective view of a game device embodying the present invention, with parts broken away for the purpose of illustration.

Referring more particularly to the drawings, and initially to FIG. 1, there is shown a game device of the type embodying the present invention which may be used to mechanically establish a secret predetermined code unknown to a player and then guide a group of game balls B in such a manner that the player is provided with information from which to deduce, after a series of plays, the pre-established code. The game balls B with which the device is used may be, for example, metal spheres or marbles of a predetermined size such that they may roll by gravitational force alone through a sequence of ball races or channels defined internally within the device.

The device includes as its principal elements five removable and interchangeable code blocks 10, 20, 30, 40, and 50 adapted to be inserted in a number of optional positions in side-by-side relationship within a base block 60. The base block 60 has an open-ended internal chamber 80 that receives the code blocks 10, 20, 30, 40, and 50 snugly therein. A release gate 90 is adapted to be slid laterally into the base block 60 above the code blocks to initially retain balls B in a preselected position. The gate 90 may then be moved slightly to release a plurality of balls that may then be conveyed by gravity force alone through the internal ball races or passageways defined by the code blocks and the interior of the base block.

I. THE CODE BLOCKS

The code blocks 10, 20, 30, 40, and 50 are all similar, but each is designed to have a different code condition, as will be seen from the description below. Nevertheless, the five code blocks will be described with reference to block 10 and corresponding parts of the other four code blocks will be identified by numerals comprising the sequential series of nine numerals following the identifying number of the particular code block.

The code block 10 has a top face 11 and parallel side faces 12 and 13. Located in the top face is a column of uniformly spaced vertical openings or holes 14 that face upwardly. One of the holes is a code hole 15, the code hole for each block being in a different position in the respective column.

Figure 3:
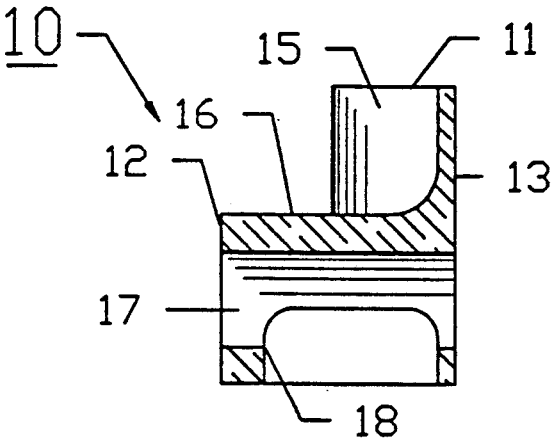
FIG. 3 is a sectional view taken on the line 3—3 of FIG. 1.
Figure 4:
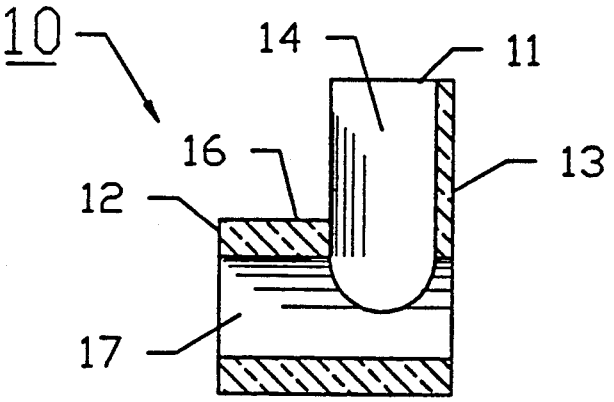
FIG. 4 is a sectional view taken on the line 4—4 of FIG. 1.
Figure 6:
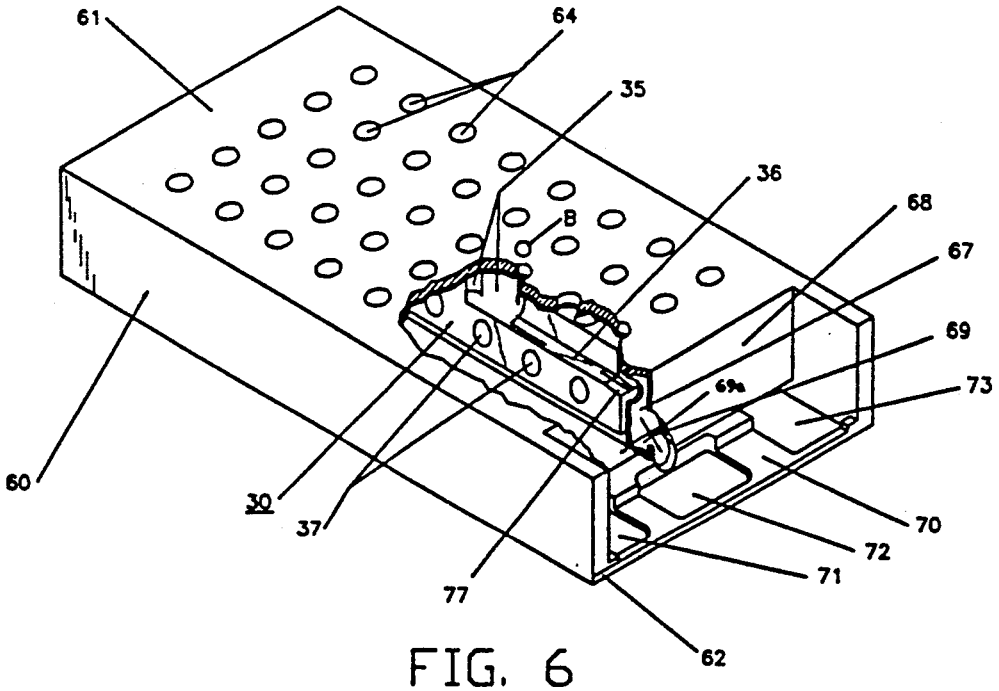
FIG. 6 is a perspective view similar to FIG. 5, with parts broken away to illustrate another route followed by a game ball through the device to another one of the ball receiver pockets.

With respect to the code block 10, the code hole 15 communicates with a longitudinal slot 16 cut in the top face 11 and side face 12 (FIGS. 3 and 4. In assembled relation, the slot 16 is defined by its intersecting surfaces in its respective code block 10 and by the adjacent side face 23 of the adjacent code block 20. The guide slot 16 is sloped somewhat downwardly from the respective code hole 15 to the inner end of the respective code block 10. The code hole 15 has a depth only to the extent of the bottom surface or floor of the guide slot 16. Accordingly, a game ball that enters the code hole 15 will roll laterally into the guide slot 16 and then longitudinally along the guide slot 16 to the end of the code block (FIG. 6).

Figure 2:
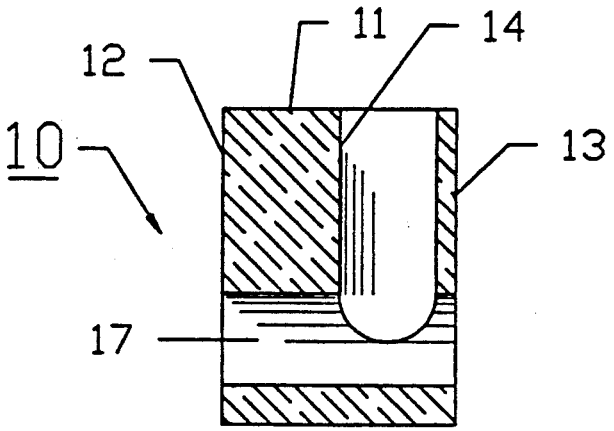
FIG. 2 is a sectional view taken on the line 2—2 of FIG. 1.
Figure 5:
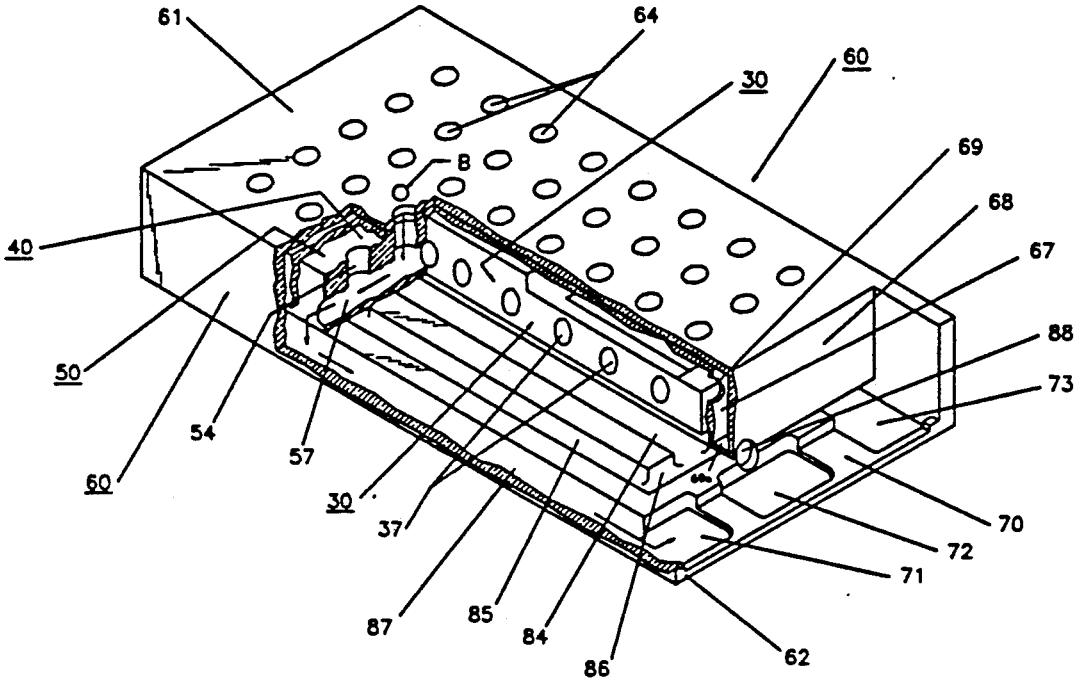
FIG. 5 is a perspective view of the game device of the invention shown in its assembled condition, with parts broken away to illustrate the movement of a game ball through the device to one of the ball receiver pockets.

The code block 10 is also provided with a series of uniformly spaced, parallel, horizontal holes 17 (FIGS. 2, 3, and 4) extending laterally through the block and spaced below the respective guide slot 16. The holes 17 are equal in number to the holes in the column of vertical holes 14 and extend entirely through the block 10 from side to side. When the code blocks are in their assembled relation, the holes 17, 27, 37, 47, 57 are all axially aligned to define a plurality of parallel passages. The horizontal holes 17 communicate with the respective vertical holes 14 except that the code hole 15 terminates above the respective horizontal hole 17. Accordingly, a game ball that is dropped into a hole in the column of holes 14 (except with respect to the code hole 15) will drop into the respective horizontal hole 17 and may be conveyed by gravity in either lateral direction, depending upon the tilt of the device (FIG. 5).

In each block 10, 20, 30, 40, 50, a vertical hole 18, 28, 38, 48, 58 is formed in the bottom surface immediately below the respective code hole 15, 25, 35, 45, 55 extending upwardly to the respective horizontal hole 17, 27, 37, 47, 57. Accordingly, a ball B rolling along one of the horizontal passages below a code hole will fall into the respective bottom hole.

II. THE BASE BLOCK

The base block 60 has a top face 61, a front end 62 and a rear end 63. The top face 61 is provided with a matrix of holes 64 arranged in columns and rows such that the columns register with the column of holes in the immediately underlying code block.

In the specific embodiment shown, there are eight holes in each column, and because there are five code blocks, there are five holes in each parallel row. When all of the code blocks are inserted in the interior chamber 80 defined by the base block, it will be apparent that the holes 64 in the top face 61 are all in axial alignment with the respective holes in the underlying code blocks.

The ball release gate 90 is positioned in a side slot 65 (FIG. 8) located in the base block and then slid into a position between the top face of the code blocks and the adjacent surface of the base block below the top face 61. The ball release gate is provided with a matrix or pattern of holes 91 that correspond to the matrix of holes in the top face 61 of the base block. The release gate 90 may be moved between an initial position wherein a ball will be blocked from falling through a hole 64 in the top face 61 and a release position wherein the holes 91 in the release gate 90 are in axial alignment with the holes in the top face 61 so that the balls may fall through the release gate into the vertical holes in the respective code blocks.

Located at the front end 62 of the base block 60 are two parallel, vertical walls 67 and 68 that define therebetween a ball hopper 69. The hopper has a sloping floor 69A that slopes from the ends to the center. The front end 62 also has a horizontal tray 70 with three ball receiver pockets 71, 72, and 73 formed therein.

The vertical wall 67 has a plurality of uniformly spaced holes 75, 76, 77, 78, and 79 (FIGS. 5 and 6) formed therein, each hole being aligned with the end of one of the guide slots 16, 26, 36, 46, 56 of the assembled code blocks 10, 20, 30, 40, 50. Accordingly, a ball rolling along one of the guide slots 16, 26, 36, 46, and 56 will, upon reaching the end of the block, pass through the respective hole 75, 76, 77, 78, and 79 into the ball hopper 69. From the hopper 69 a ball or balls will roll through another hole 88 in the vertical end wall 68 into the ball receiver pocket 72 (FIG. 6).

As indicated above, the base block 60 defines an open-ended internal chamber 80 that receives the assembled code blocks. The floor of the interior chamber 80 is provided with five parallel, longitudinal ball races 81, 82, 83, 84, and 85. The ball race 81 is located immediately below the code block 10 and is adapted to receive a ball that falls through the bottom hole 18 that communicates with the respective horizontal hole 17

Figure 7:
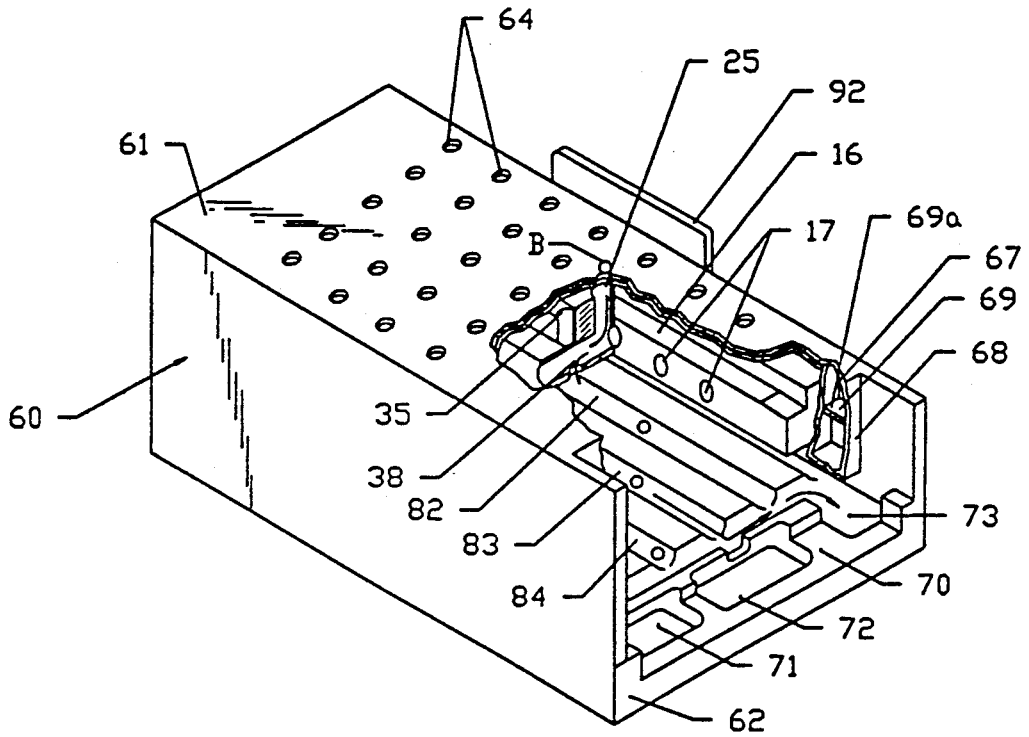
FIG. 7 is a perspective view similar to FIGS. 5 and 6 of the game device of the invention, with parts broken away to illustrate still another route followed by a game ball through the device to still another one of the ball receiver pockets.

(FIG. 7). Likewise, the respective bottom hole 28, 38, 48, and 58 of the other four blocks communicates with the respective ball race 82, 83, 84, and 85 located below the respective code block.

Balls received in the ball grooves 81, 82, 83, 84, and 85 roll longitudinally to the forward end of the base block, where they enter a lateral collector groove or race 86. The race 86 extends laterally from the race 85 to the opposite side of the base block and then communicates with the ball receiver pocket 73. Accordingly, any ball that falls through one of the bottom holes 18, 28, 38, 48, and 58 ultimately enters the receiver pocket 73 (FIG. 7).

Formed at the left-hand side of the interior chamber 80 of the base block 60 is a ball collector race 87 that slopes downwardly toward and communicates with the ball receiver pocket 71. The side race or collector race 87 is adapted to receive any balls that roll laterally through the passages formed by the aligned horizontal holes 17, 27, 37, 47, and 57 and then exit those passages at the left-hand side, as indicated in FIG. 5. Clearance is provided between the side face 52 of the code block 50 to permit the balls sufficient space to fall into the race 87.

The release gate 90 has a downwardly extending flange 93 at its inner end that is located adjacent the side 52 of the code block 50. The flange operates as a release means for balls received in any of the parallel passages formed by the aligned horizontal holes 17, 27, 37, 47, and 57 in the code blocks. When the release gate 90 is in its outward position, the flange 93 blocks the left hand ends of the parallel passages. When the gate 90 is moved inward, the flange 93 is spaced from the ends of the passages so that balls may roll from the passages into the race 87.

When the release gate is first moved inward to permit balls to fall into the vertical holes in the respective code block, it is thereafter promptly returned to the initial position. This serves to block the ends of the parallel passages until the balls that fall into the parallel passages may be rolled back and forth to find any bottom holes 18, 28, 38, 48, 58 that may be in the respective passage.

After this, the release gate is again moved inward to release any remaining balls from the passages to the collector race 87, and thence to the receiver pocket 71.

FIG. 5 illustrates the path followed by a game ball through the device into the receiver pocket 71.

FIG. 6 illustrates the path followed by a game ball that is placed in a code hole and thus rolls eventually into the ball receiver pocket 72.

FIG. 7 illustrates the path followed by a game ball B placed in a hole other than a code hole, but which lies in the same row of holes as the code hole and therefore falls initially into one of the horizontal holes 17, 27, 37, 47, and 57, but then falls through the bottom hole 18, 28, 38, 48, 58 in the respective code block located immediately below the respective code hole. That ball will roll through one of the ball races 81, 82, 83, 84, and 85 into the collector race 86 and thence into the ball receiver pocket 73.

III. OPERATION

The device may be used to play games according to a variety of different rules. However, in a typical manner of play, the player selects five code blocks all of which may have a code hole. If desired, however, some code blocks (not shown) may be selected that do not have code holes. This makes the game somewhat simpler and preferable, for example, for play by a beginner.

The player, without looking at the blocks, arranges them in a random fashion, in side-by-side relation, and inserts them through the access opening 66 at the rear end of the base block 60. At this point, the ball release gate 90 is positioned in the side slot 65 in the base block, in the manner illustrated in FIG. 8.

The holes 64 in the top face of the base block may be identified in a variety of ways, such as by numbering the columns, as illustrated in FIG. 1, and assigning different colors to each row. Also, the rows may be identified by letters of the alphabet or other symbols if desired.

The player places five balls B, one in a hole of each column. Then the release gate 90 is moved inward slightly to release the balls and permit them to fall into the vertical holes in the respective code blocks, after which the gate is returned to the initial position. Those balls which have not been placed in a code hole, and which have not been placed in the same row as a code hole, will drop through the respective vertical holes in the code blocks into the horizontal holes of the code block.

Those balls which have been placed in a hole that is not a code hole but lies in the same row as a code hole will drop through the respective vertical hole of the base block and into the respective horizontal hole. Then a ball will roll alternately right and left (by tipping the device) to see if it will fall through one of the bottom holes. Since the ball referred to is in the same row as a code hole, it will eventually fall through a bottom hole into one of the grooves 81, 82, 83, 84, and 85. The ball will then roll along the groove to the collector race 86, from whence it rolls into the ball receiver pocket 73.

Figure 8:
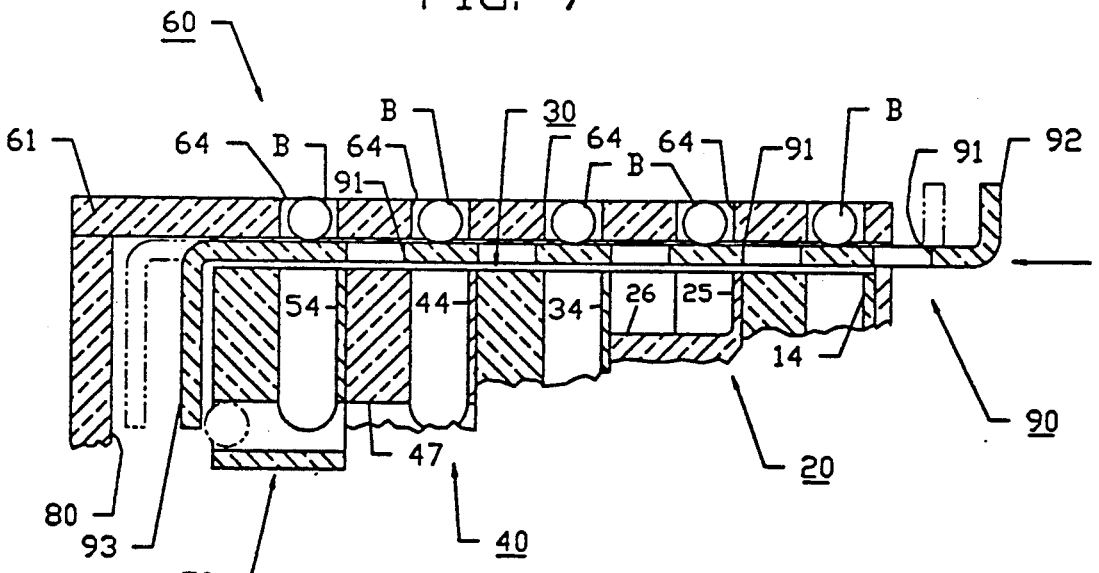
FIG. 8 is a fragmentary, cross-sectional view of the game device of the invention illustrating the position of the ball release gate prior to release of the balls from their preliminary positions on the top face of the device.

Once no more balls fall through the bottom holes, the release gate is returned to the inward release position, as shown in FIG. 8. This will allow any balls remaining in the horizontal passages to roll into the side race 87 (upon tipping the device to the left). Then those balls will roll into the ball receiver pocket 71.

A ball which is received in a code hole of a code block will roll laterally into one of the guide slots 16, 26, 36, 46, 56, from which it will roll toward the vertical wall 67 and then through one of the holes 75, 76, 77, 78, and 79 into the ball hopper 69. From the ball hopper 69, the ball will roll out through the hole 88 into the ball receiver tray 72.

It will be seen that the player receives certain information or clues as to what the concealed code is as a result of the number of balls in each one of the ball receiver pockets. Normally, the player will record the initial positions that were selected for the balls and the results represented by the number of balls in each one of the ball receiver pockets. The player then decides upon his next selection of holes in the top face of the base block and repeats the procedure. The information obtained from the second play is cumulative, and places the player closer to the solution as to the secret code.

The object of a typical game played with the device A is to determine the code by deductive reasoning after a minimum number of plays.

It will be understood that the device may be used for playing a variety of games and that, if desired, two or more people may compete with one another. FIG. 1 shows a typical overlay that may be used with the device to facilitate play of one particular variation of game.

While the invention has been shown and described with respect to a specific embodiment thereof, this is for the purpose of illustration rather than limitation, and other variations and modifications of the specific embodiment herein shown and described will be apparent to those skilled in the art all within the intended spirit and scope of the invention. Accordingly, the patent is not to be limited in scope and effect to the specific embodiment herein shown and described nor in any other way that is inconsistent with the extent to which the progress in the art has been advanced by the invention.

What is claimed is:

1. A game device wherein the movement of games balls by gravity from selectable holes through a changeable passage means to receiver pockets in accordance with a concealed code provides facts to the user from which to deduce the concealed code, comprising:

a base block having a longitudinal axis, a top face adapted to be located in a plane that is tilted relative to the horizontal and first, second, and third ball receiver pockets;

a plurality of code blocks adapted for insertion longitudinally in said base block in interchangeable side-by-side assembled relation laterally adjacent to one another and having a predetermined orientation relative to said base block, each code block having a top face with a longitudinal column of uniformly spaced, vertical holes perpendicular to the top face that align laterally with the vertical holes of adjacent code blocks to form lateral rows of holes, one hole of a column being a code hole and the other holes of that column being non-code holes;

said base block having a plurality of upwardly facing holes in and perpendicular to its top face arranged in longitudinal columns and lateral rows, said base block holes being in vertical axial alignment with the vertical holes of the longitudinal columns of holes and lateral rows of holes of the assembled code blocks;

first means defined by said code blocks and said base block for conveying a ball inserted in the code hole of one of said code blocks, by gravity, to the first ball receiver pocket;

second means defined by said code blocks and said base block for conveying a ball inserted in one of said non-code holes in the same lateral row as one of the code holes, by gravity, from its hole in that row to the seconde ball receiver pocket; and third means defined by said code blocks and said base block for conveying a ball inserted in a non-code hole in a lateral row that has no code holes, by gravity, to the third ball receiver pocket.

2. A game device as defined in claim 1, wherein said first means comprises a longitudinal guide slot formed in each code block and extending longitudinally along the code block from an end of the slot that communicates with a code hole of the respective code block and an opposite end whereat said slot communicates with said first ball receiver pocket in said base block, whereby a ball received in a code hole will roll to said first ball receiver pocket.

3. A game device as defined in claim 2, wherein said second means comprises a plurality of horizontal holes in each code block extending laterally and perpendicular to the respective column of upwardly facing vertical holes of said code block and located below the respective code block guide slot of said first means, said horizontal holes being in axial alignment with the laterally extending horizontal holes of the other code blocks to form a plurality of lateral passages, each extending transversely through all of the code blocks, each upwardly extending hole except the code hole on the respective block being in operative communication with the respective horizontal hole, the code hole being in operative communication only with the respective longitudinal slot, there being an opening extending downwardly from said respective horizontal hole below the code hole and communicating with passage means in the floor of said base block that communicates with said second ball receiver pocket, whereby balls not received in a code hole but received in a hole in a lateral row containing a code hole will roll to said second ball receiver pocket.

4. A game device as defined in claim 3, wherein said third means comprises a longitudinally extending ball collector race formed at one side of said base block in the interior thereof and extending parallel to said code blocks, said collector race communicating with an end of each of said laterally extending horizontal passages through said code blocks and being in operative communication with said third ball receiver pocket whereby balls not received in a code hole nor in a non-code hole in a lateral row that contains a code hole will travel by gravity to said third ball receiver pocket.

5. A game device as defined in any of claims 1, 2, 3, or 4 further comprising a ball release gate adapted to be slidably inserted laterally between said top face of said base block and said code blocks, said release gate being a relatively thin, rigid rectangular plate with a pattern of holes that is identical to the pattern of holes in the top face of the base block, the release gate being movable laterally between an initial position wherein it blocks balls inserted in the holes in said top face of said base block from dropping through to the vertical holes in said code blocks, and a release position wherein said holes in said release gate are in vertical axial alignment with the holes in the top face of said base block to permit balls placed in said holes in said to face to drop through the holes in said release gate to said vertical holes in the respective code blocks.

* * * * *